US008869730B2

(12) United States Patent
Eatwell

(10) Patent No.: US 8,869,730 B2
(45) Date of Patent: Oct. 28, 2014

(54) BACK SUPPORT FOR AN INFLATABLE BOAT

(71) Applicant: Graham Paul Eatwell, Annapolis, MD (US)

(72) Inventor: Graham Paul Eatwell, Annapolis, MD (US)

( * ) Notice: Subject to any disclaimer, the term of this patent is extended or adjusted under 35 U.S.C. 154(b) by 109 days.

(21) Appl. No.: 13/694,041

(22) Filed: Oct. 23, 2012

(65) Prior Publication Data

US 2014/0109822 A1 Apr. 24, 2014

(51) Int. Cl.
*B63B 17/00* (2006.01)

(52) U.S. Cl.
USPC ..... 114/363; 441/40

(58) Field of Classification Search
USPC ..... 114/343, 345, 363; 441/40, 131
See application file for complete search history.

(56) References Cited

U.S. PATENT DOCUMENTS

| | | | | |
|---|---|---|---|---|
| 4,909,177 | A | 3/1990 | Jones | |
| 5,101,753 | A | 4/1992 | Hull | |
| 5,154,134 | A | 10/1992 | Goldsmith | |
| 5,325,806 | A | 7/1994 | Lee | |
| 5,769,022 | A * | 6/1998 | Luxford | 114/345 |
| 2012/0132128 | A1 * | 5/2012 | Nguyen | 114/363 |

* cited by examiner

*Primary Examiner* — Lars A Olson

(57) ABSTRACT

A method and apparatus for providing back support for a user seated on an inflated tube of an inflatable boat. A support element, which supports the user's back, is coupled to one or more anchor points within the boat via circum-tubular coupling elements that prevent the support element from rotating about the tube.

21 Claims, 9 Drawing Sheets

BACK SUPPORT FOR AN INFLATABLE BOAT

PRIORITY CLAIM

This application claims priority from Provisional Application Ser. No. 61/628,104 filed Oct. 24, 2011, titled "Back Support for an Inflatable Boat", which is hereby incorporated herein.

BACKGROUND

Inflatable boats are characterized by one, or more, inflatable tubes, a floor and a transom. The inflated tubes provide much more buoyancy and stability than a rigid boat of a similar size.

Commonly, seats provided for inflatable boat are either transverse benches or forward facing seats. A disadvantage of a forward face seat is that the controls of an outboard motor are located behind the helmsman, where they are difficult to reach or see.

Passengers, in inflatable boats commonly sit either within the boat, on a bench seat, a frame supported seat or a central console, or else they sit on the side of the boat on one of the inflatable tubes (also called pontoons). The latter position is often preferred by the helmsman, especially when the inflatable boat is powered by an outboard motor with a tiller. In addition, seating within the boat is often limited, so some passengers sit on the tubes.

A disadvantage of sitting on the tube is that no back support is provided. Sitting, without back support, for an extended period of time is tiring. In addition, when sitting on a tube without a back support there is a risk that a person will lose their balance and fall out of the boat, especially when the boat is hit by a wave or wake or is subject to a harsh maneuver.

BRIEF DESCRIPTION OF THE FIGURES

The accompanying figures, in which like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
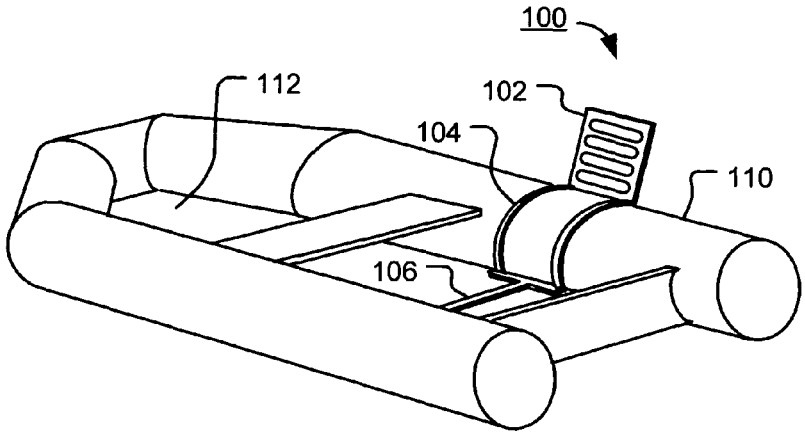
FIG. 1 is a diagram of an exemplary back support for an inflatable boat in accordance with some embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to the provision of back support in a small boat. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIG. 1 shows an example of a back support 100 for an inflatable boat in accordance with some embodiments of the invention. The boat may be fully inflatable, or it may be a rigid inflatable boat (RIB) with a rigid hull.

Although the description below is directed towards boats having inflatable tubes, the back support may be used in other boats having tube-shaped sides. Examples include boats with molded PVC sides, or foam filled fiberglass sides.

The back support 100 includes a support element 102, circum-tubular coupling elements 104, and a transverse brace 106.

Figure 2:
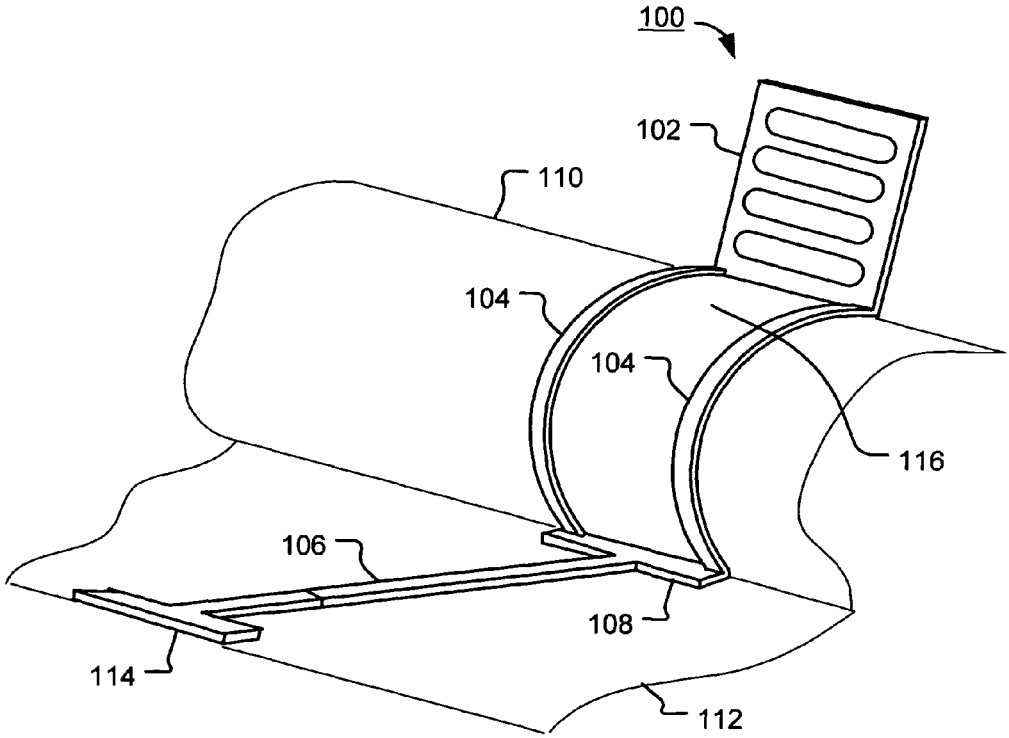
FIG. 2 is a more detailed view of the example back support shown in FIG. 1.

FIG. 2 is a more detailed view of the exemplary back support 100 shown in FIG. 1. Referring to FIG. 2, the circum-tubular coupling elements, 104, couple the support element 102 to the transverse brace 106 at, or close to, a first end 108 of the transverse brace 106. The transverse brace 106 provides one or more anchor points for the circum-tubular coupling elements 104. Alternative anchoring structures are described below and additional anchoring structures will be apparent to those of ordinary skill in the art.

In use, the first end 108 of the transverse brace 106 is positioned at the joint between an inflatable tube 110 of an inflatable boat and the floor 112. The transverse brace 106 spans the width of the floor 112. The second end 114 of the transverse brace 106 is positioned at the joint between the opposite inflatable tube and floor 112.

In one embodiment, the length of the transverse brace is adjustable. It may be adjustable only once (e.g. cut to fit) or adjustable multiple times. Various means for providing length adjustment in an elongated element are known to those of ordinary skill in the art. These include telescoping elements, pivoting elements, one or more scissor elements, screw elements, sliding elements, etc. Any of these means may be utilized in the present invention either separately or in combination.

In one embodiment, the length of the transverse brace is locked after adjustment. A number of locking mechanisms are known to those of ordinary skill in the art, including ratchets, cams, screws, pins, etc. In a further embodiment, the transverse brace is held in place by a spring force.

In one embodiment, the length of a transverse brace is fixed. In this embodiment the end 114 may be pivoted on the cross arm to enable the transverse brace to be rotated into position. The pivot may be locked once the end of the transverse brace is substantially perpendicular to the cross-arm of the transverse brace. The transverse brace may have a non-slip surface, such as a rubberized surface, to help to retain its position within the boat.

Figure 3:
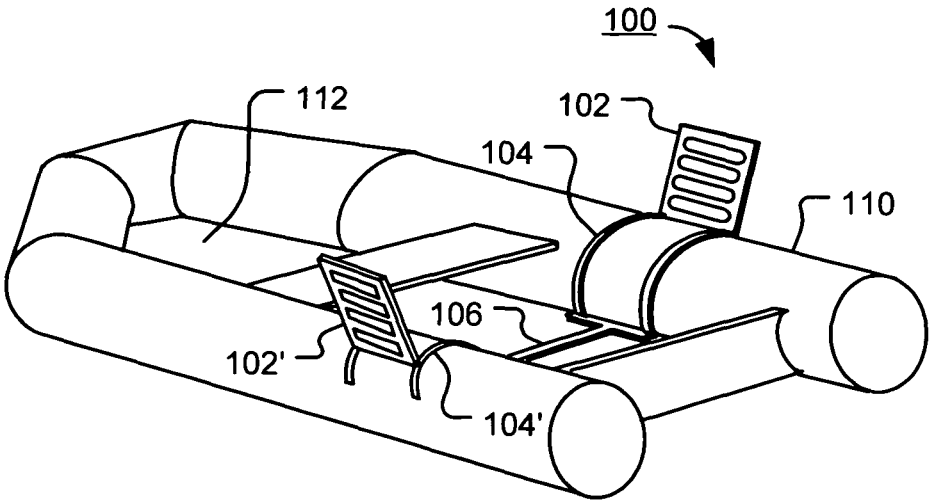
FIG. 3 shows an example of dual back supports for an inflatable boat in accordance with some embodiments of the invention.

FIG. 3 is an example of dual back supports for an inflatable boat in accordance with some embodiments of the invention. The arrangement shown in FIG. 3 has first support element 102, coupled to the transverse brace 106 by first circum-tubular coupling elements 104, and a second support element 102', coupled to the transverse brace 106 by second circum-tubular coupling elements 104'.

Buckling of the transverse brace is resisted by the stiffness of the brace or by pre-bending of the brace so that further bending is prevented by the floor of the boat.

The transverse brace 106 may have one, two or more cross arms.

The circum-tubular coupling elements 104 may be fixedly or removably coupled to the transverse brace 106 or may be formed integrally with the bracing element. In one embodiment, the circum-tubular coupling elements 104 are spaced apart horizontally in use, such that a user may sit on the region 116 of the inflatable tube 110 between the coupling elements 104.

The circum-tubular coupling elements 104 may be flexible to allow use with inflatable tubes of various diameters.

In one embodiment, the circum-tubular coupling elements 104 are sized for use with inflatable tubes within a specified range of diameters.

The support element 102 may be fixedly or removably coupled to the circum-tubular coupling element 104 or may be formed integrally with them.

In operation, user pressure against the support element 102 applies a rotational force to the circum-tubular coupling elements 104. Rotation of the circum-tubular coupling elements 104 is resisted by the transverse brace 106.

Figure 4:
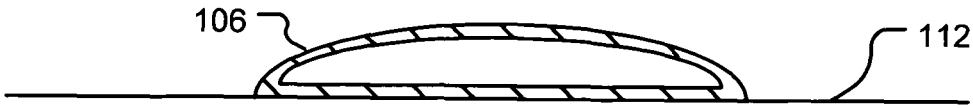
FIG. 4 is a cross-sectional view of a transverse brace in accordance with some embodiments of the invention.

FIG. 4 is a cross-sectional view of an exemplary transverse brace 106 in accordance with some embodiments of the invention. In the embodiment shown in FIG. 4, the top side of the brace 106 has a curved profile to reduce the chance of a user tripping on the brace when moving about the boat. The curvature also increases the rigidity of the brace. Other cross-sectional profiles may be used. The underside of the transverse brace may be coated with a non-slip material.

Figure 5:
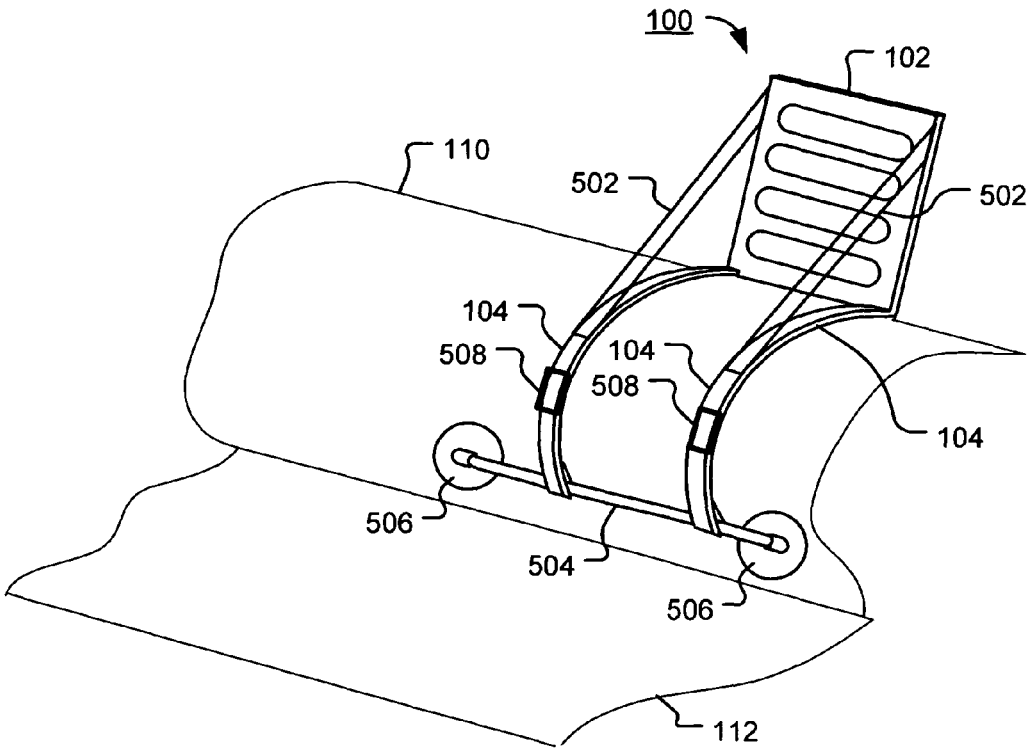
FIG. 5 is a further exemplary back support for an inflatable boat with glued-on anchor pads in accordance with some embodiments of the invention.

FIG. 5 is a further example of a back support 100 for an inflatable boat in accordance with some embodiments of the invention. In this embodiment, the support element 102 is held by circum-tubular couplers 104 and by straps 502. The straps and couplers are connected to a bar 504 that, in turn, is coupled to the inflatable tube 110 with glued-on anchor pads 506. The length of the straps may be adjusted using buckles 508, for example. This enables the angle of the back support to be adjusted. A single strap that passes around the back of the back support may be used. Alternatively, two separate straps may be used. Use of bar 504 allows the fore-aft position of the back support to be adjusted.

Figure 6:
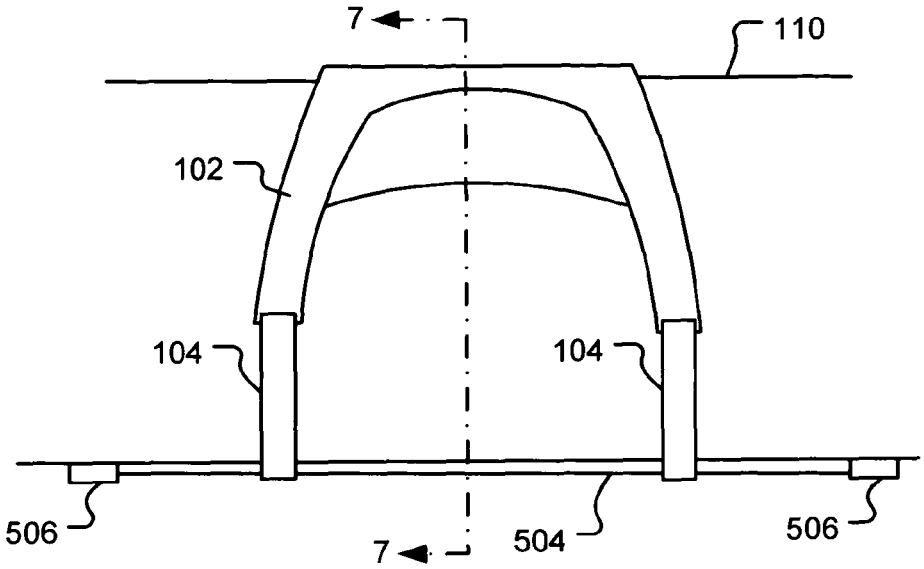
FIG. 6 is an exemplary molded back support for an inflatable boat in accordance with some embodiments of the invention.

FIG. 6 is an exemplary molded back support for an inflatable boat in accordance with some embodiments of the invention. In this embodiment the support element 102 is attached via circum-tubular coupling elements 104 to a bar 504. The bar is attached to the tube via glue-on anchor pads 506. The lower surface of the support element 102 is curved to match the curvature of the inflatable tube 110. The support element may be constructed of a hollow plastic material, a solid plastic material, foam, or other material. It may be formed by molding, or by other manufacturing techniques.

Figure 7:
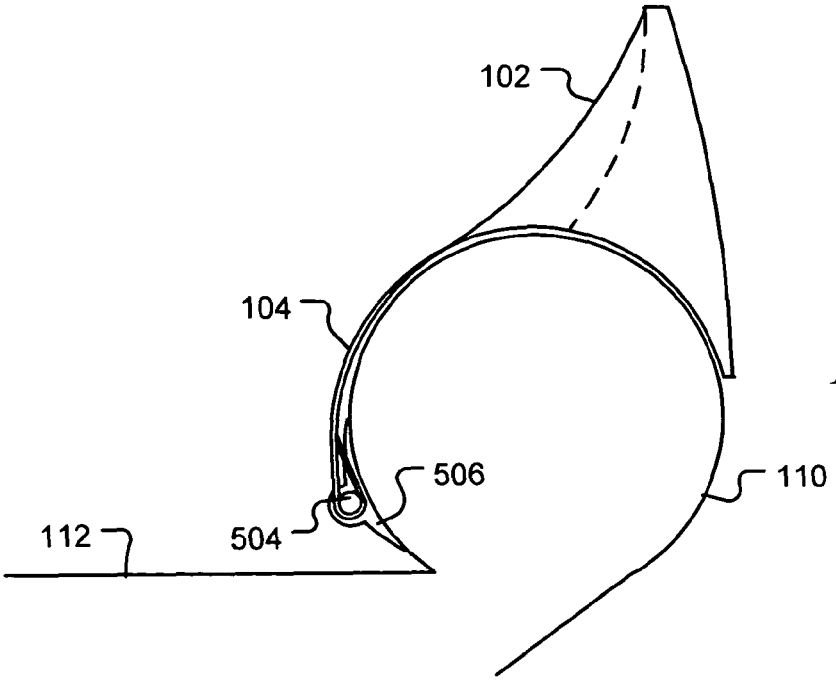
FIG. 7 is a side view of the back support shown in FIG. 6.

FIG. 7 is a side view of the back support shown in FIG. 6. The circum-tubular straps 104 may be attached to the support element by various means, or may be integral with the support element. The support element 102 may be constructed of buoyant foam material and may be detachable to provide a floatation aid.

Figure 8:
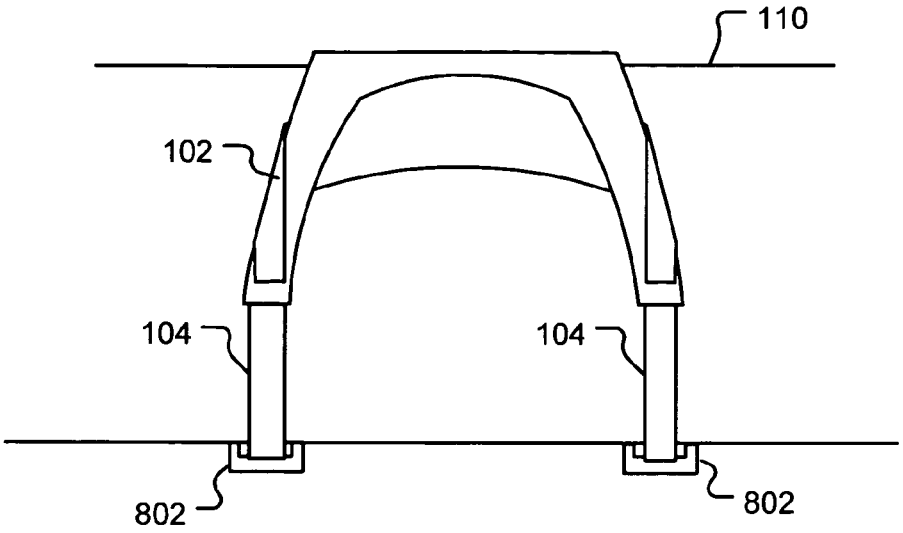
FIG. 8 is an exemplary molded back support with a continuous strap in accordance with some embodiments of the invention.

FIG. 8 is an exemplary molded back support with a continuous strap in accordance with some embodiments of the invention. In this embodiment, the support element 102 is held in place on the tube 110 by a single strap 104, such as a woven strap, that passes around the rear of the support element. The strap is attached to anchor pads 802.

Figure 9:
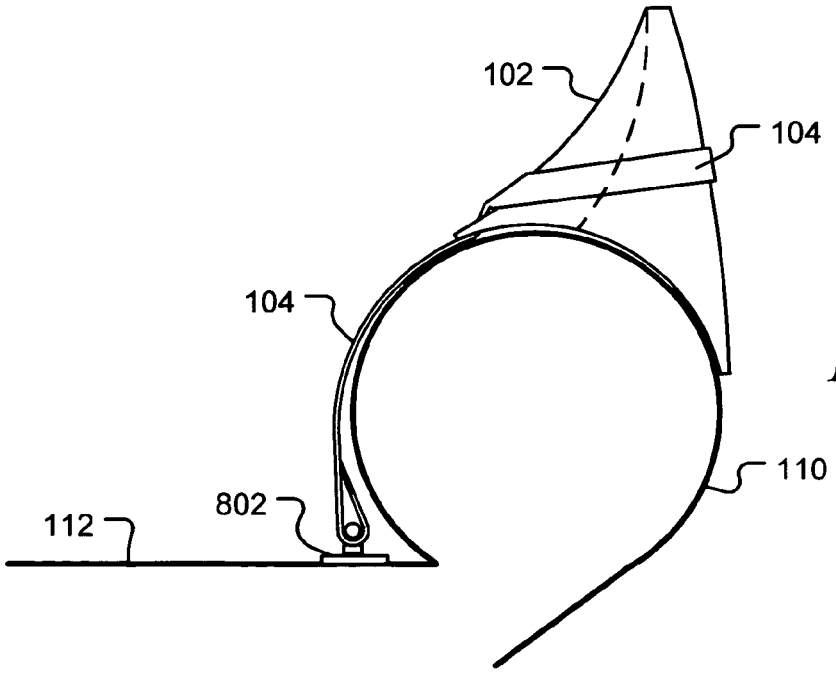
FIG. 9 is a side view of the back support shown in FIG. 8.

FIG. 9 is a side view of the back support shown in FIG. 8. In this embodiment, the anchor pads 802 are attached to the floor 112 of the boat, and the strap ends are attached directly to the anchor pads, rather than to a bar. Other forms of attachment may be used.

Figure 10:
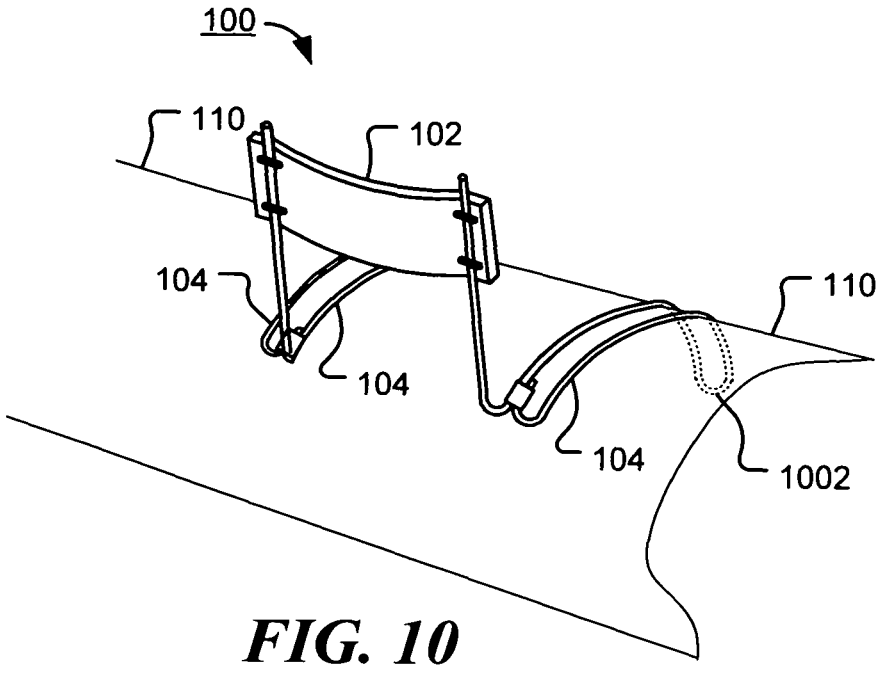
FIG. 10 is an exemplary back support with a rod or tubular frame in accordance with some embodiments of the invention.

FIG. 10 is an exemplary back support 100 with a rod or tubular frame in accordance with some embodiments of the invention. Referring to FIG. 10, the support element 102 is mounted on frames 104. The frames may be constructed from metal rods or tubes, for example. Aluminum, stainless steel, or other corrosion resistant materials may be used. The frames 104 are circum-tubular coupling elements, and may be attached, at ends 1002, to anchor points on the inside of the tube 110 or on the boat floor. The frames are curved to match the profile of the tube. In the embodiment shown in FIG. 10, the curved portion of the frame is doubled-back to distribute the forces applied to the tube 110. Other means to distribute the forces across the surface of the tube may be used, such as a larger diameter frame or rigid attachments. The frames 104 may be removably attached to the support element 102 to allow for compact storage.

Figure 11:
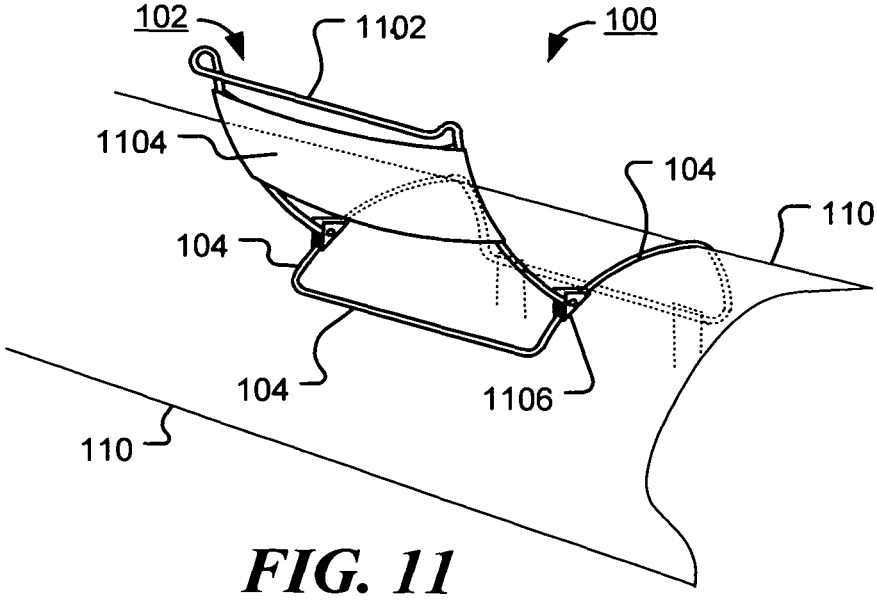
FIG. 11 is a further exemplary back support with a rod or tubular frame in accordance with some embodiments of the invention.

FIG. 11 is a further exemplary back support with a rod or tubular frame in accordance with some embodiments of the invention. In this embodiment, the circum-tubular coupling element is implemented as a first frame 104. The support element 102 comprises a second frame 1102 that supports a transverse element 1104. The transverse element 1104 may be a flexible material, such as cloth or mesh, or a more rigid material such as a plastic, for example. The second frame 1104 is coupled to the first frame 104 at hinges 1106. In one embodiment, the vertical sides of the second frame have the same curvature as the coupling element 104. This enables the second frame 1102 to be folded inwards onto the first frame 104. This allows compact storage and facilitates easier boarding and disembarkation. The inboard edge of the circum-tubular coupling element 104 may be attached to anchor points either directly or via straps, for example.

Figure 12:
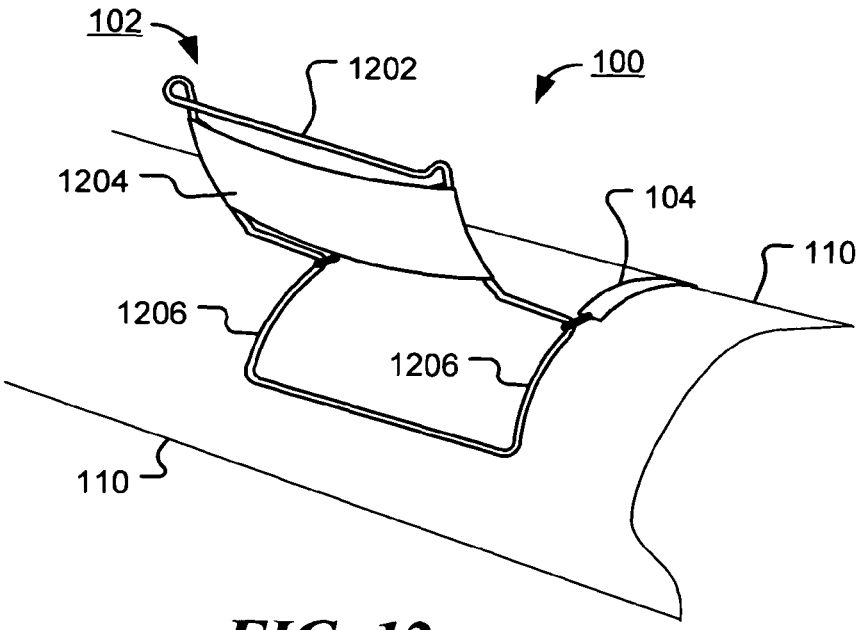
FIG. 12 is a still further exemplary back support with a rod or tubular frame in accordance with some embodiments of the invention.

FIG. 12 is a still further exemplary back support with a rod or tubular frame in accordance with some embodiments of the invention. In the embodiment shown in FIG. 12, the support element 102 comprises a frame 1202, and transverse element 1204. The side portions 1206 of the frame 1202 are curved to match the curvature of the inflated tube 110. The upper portion of the frame 1202 may be hinged to the lower portion 1206 to enable the upper portion to be folded inwards when not in use. The support element 102 is coupled to the interior of the boat via circum-tubular coupling element 104 that may be a flexible strap or webbing, for example. Alternatively, the flexible strap 104 may be glued to the inflated tube 110. A pad may be used in place of the strap, but the strap distributes the load across a greater area of the tube 110.

Figure 13:
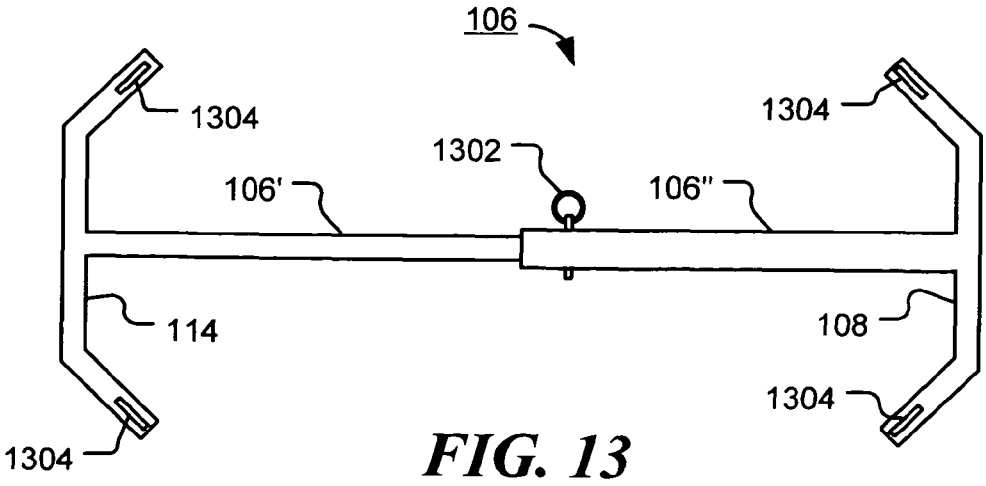
FIG. 13 is a diagram of an exemplary transverse brace, in accordance with certain embodiments of the present invention.

FIG. 13 is a diagram of an exemplary transverse brace 106, in accordance with certain embodiments of the present invention. Referring to FIG. 13, the transverse brace 106 has a first portion 106' and a second portion 106". In one embodiment, the first portion 106' slides inside of the second portion 106" and is locked in place by pin 1302. In a further embodiment, the first portion 106' is hinged to the second portion 106" and is locked in place by pin 1302. The pin 1302 may be a quick release pin to enable the transverse brace 106 to be easily removed and installed. The first end 108 and second end 114 support anchor points 1304. The anchor points 1304 may be loops for attaching straps or fasteners, holes for receiving fasteners, or simply regions of the brace to which fasteners such as clamps may be attached.

The transverse brace 106 may be used to provide anchor points for one or more back supports. The transverse brace 106 may also be used to provide support for other items including, but not limited to, storage containers, life lines, oars etc. The transverse brace may also provide support for vertical members that, in turn, support shade elements (such as a bimini top or a parasol) or grab rails. Multiple transverse braces may be used in conjunction to provide increased support.

Figure 14:
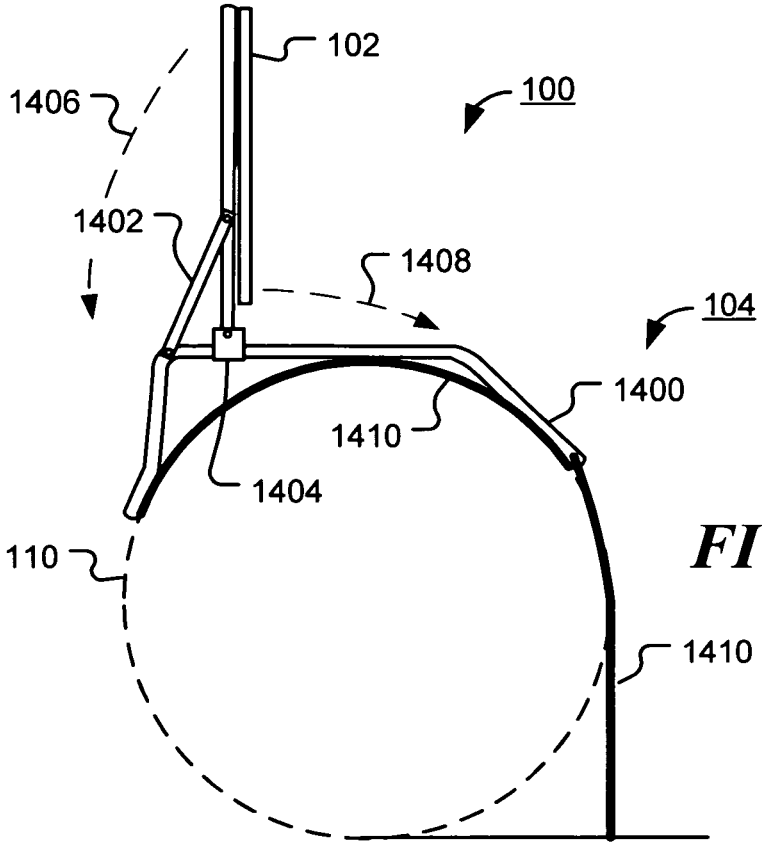
FIGS. 14 and 15 show a foldable back support, in accordance with certain embodiments of the present invention.
Figure 15:
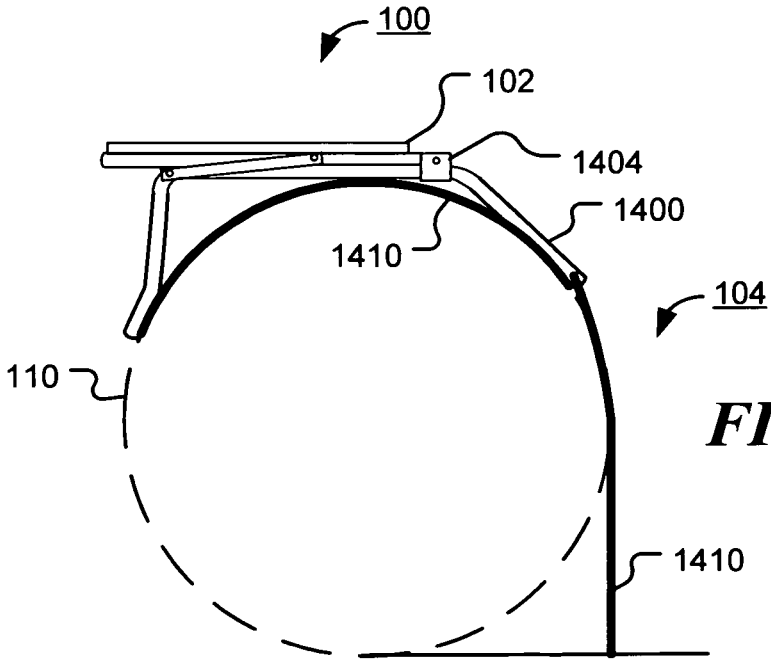

FIGS. 14 and 15 show a foldable back support 100, in accordance with certain embodiments of the present invention. In FIG. 14 the support element 102 is mounted on a frame 1400 and coupled to frame 1400 via a strut 1402 and a slidable member 1404. The strut 1402 is rotatably coupled to the frame 1440 at one end and to the support element 102 at the other end, using a pin, for example. The circum-tubular coupling element 104 comprises frame 1400 and strap 1410. The slidable member 1402 may be locked in position using removable pin, for example. When the pin is removed, the support element 102 may folded outward, with respect to the inflatable boat, in the direction of arrow 1406, while the slidable member 1404 slides in the direction of arrow 1408 on the frame 1400 to the configuration shown in FIG. 15. In FIG. 15, the support element 102 is substantially horizontal and provides a substantially horizontal surface that may be used as a seat, or as a step for boarding or disembarking. In the horizontal configuration, the support element 102 does not impede boarding or disembarkation. In this embodiment, the circum-tubular coupling elements 104 also include straps that couple the frame 1400 portion to the interior of the boat. The frame 1400 may be constructed of stainless steel tube, aluminum tube or other material and is shaped to match the curvature of the inflated tube 110.

The support element 102 is operable to support the back of a user seated on an inflated tube of the inflatable boat. The circum-tubular coupling element 104, comprising frame 1400 and one or more straps 1410, is operable to couple the support element 102 to at least one anchor point within the inflatable boat. In operation, the at least one circum-tubular coupling element 104 prevents outward rotation of the support element about the inflated tube.

Figure 16:
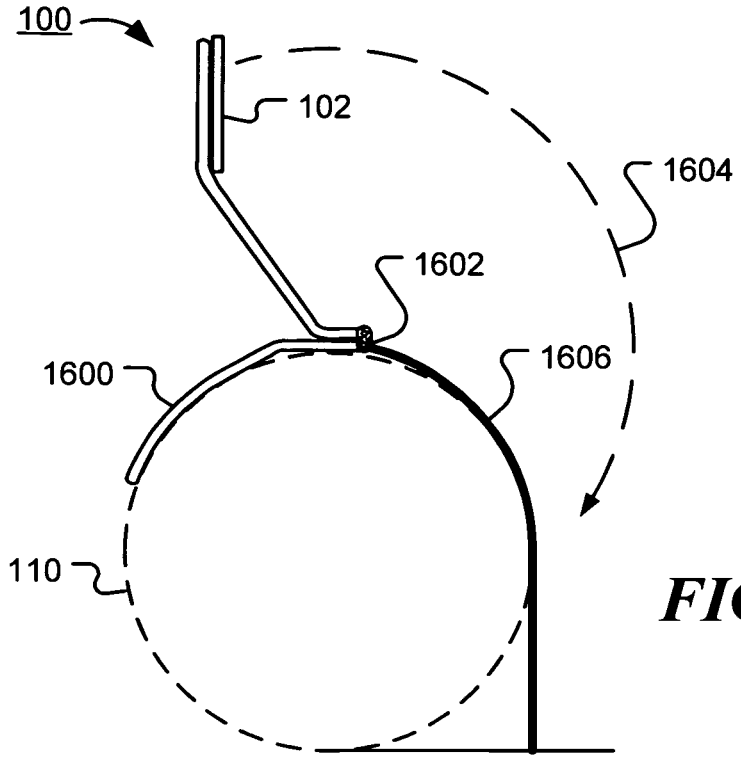
FIGS. 16 and 17 show a further foldable back support, in accordance with certain embodiments of the present invention.
Figure 17:
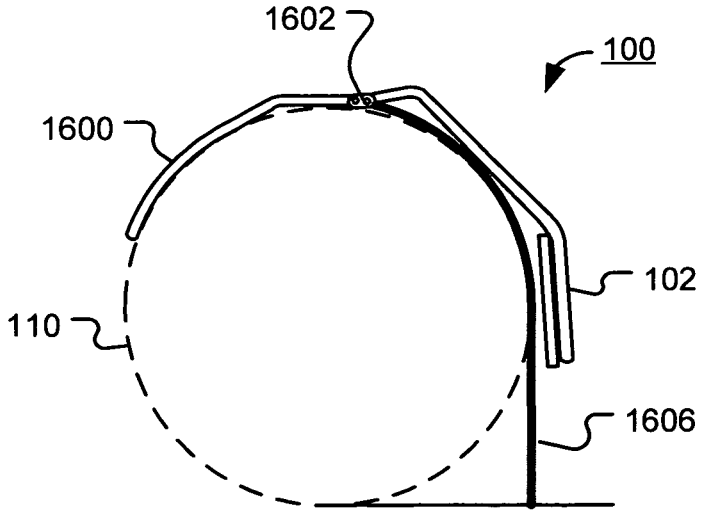

FIGS. 16 and 17 show a further foldable back support 100, in accordance with certain embodiments of the present invention. In FIG. 16, the support element 102 is hinged to frame 1600 at hinge 1602, enabling the back rest to be folded inwards, with respect to the inflatable boat, in the direction of arrow 1604. The folded back support is shown in FIG. 17. In the folded position, the support element 102 does not impede embarkation and disembarkation. The frame portion of support element 102 may comprise angled sections, as shown in FIG. 16, or may be curved to follow the contour of the tube 110. In this embodiment, the circum-tubular coupling elements comprise frame 1600 and straps 1606 that couple the frame to the interior of the boat. The frame 1600 is shaped to match the curvature of the inflated tube 110.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims.

What is claimed is:

1. A back support for an inflatable boat, the back support comprising:

a support element, operable to support the back of a user seated on a portion of an inflated tube of the inflatable boat, the portion of the inflated tube having a longitudinal axis; and at least one circum-tubular coupling element, operable to couple the support element to at least one anchor point within the inflatable boat, where, in operation, the at least one circum-tubular coupling element passes around the longitudinal axis of the portion of the inflated tube, is supported at least in part by the inflated tube and prevents rotation of the support element about the inflated tube, and where the at least one circum-tubular coupling element comprises at least one flexible strap.

2. A back support in accordance with claim 1, where the at least one flexible strap loops around the back of the support element.

3. A back support in accordance with claim 1, where the at least one circum-tubular coupling element comprises two flexible straps, each flexible strap attached to one side of the support element.

4. A back support in accordance with claim 1, where the support element is buoyant and is detachable to form a floatation aid.

5. A back support in accordance with claim 1, further comprising a bar adapted to be fixed to an interior surface of the inflatable boat, where the at least one circum-tubular coupling element is operable to couple between the support element and the bar.

6. A back support in accordance with claim 1, where the at least one flexible strap is adapted to be glued to the inflated tube.

7. A back support for an inflatable boat, the back support comprising:

a support element, operable to support the back of a user seated on an inflated tube of the inflatable boat; and at least one circum-tubular coupling element, operable to couple the support element to at least one anchor point within the inflatable boat, where in operation, the at least one circum-tubular coupling element prevents rotation of the support element about the inflated tube, and where the at least one circum-tubular coupling element comprises at least one first frame shaped to match the curvature of the inflated tube and configured rest on and be supported by the inflated tube.

8. A back support in accordance with claim 7, where the support element comprises:

a second frame, coupled to the at least one first frame; and a transverse element supported by the second frame, where, in operation, the back of a user is supported by the transverse element.

9. A back support in accordance with claim 8, where the transverse element comprises a flexible material.

10. A back support in accordance with claim 8, where the sides of the second frame are hinged to the at least one first frame.

11. A back support in accordance with claim 7, wherein the inflated tube comprises a first section on one side of the inflatable boat and a second section on an opposite side of the inflatable boat, the back support further comprising:

a transverse brace having at least one anchor point, operable to span the width of the inflatable boat between the first and second sections of the inflated tube, where the at least one circum-tubular coupling element is operable to couple between the support element and the at least one anchor point on the transverse brace.

12. A back support in accordance with claim 11, where the length of the transverse brace is adjustable to facilitate installation in inflatable boats of different widths.

13. A back support in accordance with claim 11, further comprising:

a second support element, operable to support the back of a second user seated on the second section of the inflated tube of the inflatable boat; and at least one second circum-tubular coupling element, operable to couple the second support element to at least one anchor point on the transverse brace.

14. A back support for an inflatable boat, the back support comprising:

a support element, operable to support the back of a user seated on an inflated tube of the inflatable boat; and at least one circum-tubular coupling element, operable to couple the support element to at least one anchor point within the inflatable boat, where the at least one circum-tubular coupling element comprises at least one first frame shaped to match the curvature of the inflated tube, where the su ort element comprises a second frame and a transverse element supported by the second frame, the sides of the second frame being hinged to the at least one first frame, where, in operation, the back of a user is supported by the transverse element and the at least one circum-tubular coupling element prevents rotation of the support element about the inflated tube, and where the sides of the second frame are curved to match the curvature of the first frame.

15. A back support for an inflatable boat, the back support comprising:

a support element, operable to support the back of a user seated on an inflated tube of the inflatable boat; and at least one circum-tubular coupling element, operable to couple the support element to at least one anchor point within the inflatable boat, where, in operation, the at least one circum-tubular coupling element prevents rotation of the support element about the inflated tube, and where a lower portion of the support element is shaped to match the curvature of the inflated tube.

16. A back support for an inflatable boat, the back support comprising:

a support element, operable to support the back of a user seated on an inflated tube of the inflatable boat;

at least one circum-tubular coupling element, operable to couple the support element to at least one anchor point within the inflatable boat, and an anchor pad, where the at least one circum-tubular coupling element is operable to couple between the support element and an anchor point on the anchor pad to prevent rotation of the support element about the inflated tube, and where the anchor pad is adapted to be fixed to an interior surface of the inflatable boat.

17. A back support for an inflatable boat, the back support comprising:

a support element, operable to support the back of a user seated on an inflated tube of the inflatable boat; and at least one circum-tubular coupling element, operable to couple the support element to at least one anchor point within the inflatable boat, where, in operation, the at least one circum-tubular coupling element prevents rotation of the support element about the inflated tube, and where the at least one circum-tubular coupling element and the support element are integrated as a single element.

18. A back support for an inflatable boat, the back support comprising:

a first frame, shaped to rest on and be supported by an inflated tube of the inflatable boat such that at least a portion of the first frame contacts an upper exterior surface of the inflated tube; and a support element, operable to support the back of a user seated on an inflated tube of the inflatable boat, the support element coupled to the first frame;

where the first frame is configured to couple to an anchor point in the interior of the inflatable to prevent rotation of the back support about the inflated tube.

19. The back support of claim 18, where the support element comprises:

a transverse element operable to support the back of the user, and a second frame that supports the transverse element and is coupled to the first frame.

20. The back support of claim 18, where the support element is rotatably coupled to the first frame to enable the support element to be folded inward with respect to the inflatable boat.

21. The back support of claim 18, where the support element is moveably coupled to the first frame to enable the support element to be folded with respect to the inflatable boat to provide a substantially horizontal surface.

* * * * *